US007214075B2

(12) United States Patent
He et al.

(10) Patent No.: US 7,214,075 B2
(45) Date of Patent: May 8, 2007

(54) PORTABLE MEMORY DEVICE WITH WATERPROOF STRUCTURE

(75) Inventors: Jia-Yong He, Kunshan (CN); Qi-Jun Zhao, Kunshan (CN); Mao-Lin Lei, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/487,889

(22) Filed: Jul. 17, 2006

(65) Prior Publication Data

US 2007/0015393 A1 Jan. 18, 2007

(30) Foreign Application Priority Data

Jul. 15, 2005 (CN) ..... 200520073719

(51) Int. Cl.
*H01R 13/44* (2006.01)

(52) U.S. Cl. ..... 439/135; 439/271; 439/136

(58) Field of Classification Search ..... 439/271, 439/587, 135, 136, 521; 220/304
See application file for complete search history.

(56) References Cited

U.S. PATENT DOCUMENTS 4,291,932 A * 9/1981 Cox ..... 439/271
4,940,420 A * 7/1990 Munie ..... 439/272
5,632,639 A * 5/1997 Hayashi ..... 439/271
6,522,534 B1 2/2003 Wu
6,682,358 B1 * 1/2004 Morris ..... 439/135
6,872,092 B2 2/2004 Oka
6,926,544 B2 8/2005 Lee
6,932,629 B2 8/2005 Ikenoue
6,999,322 B1 * 2/2006 Lin ..... 361/752
2005/0220434 A1 * 10/2005 Hsieh ..... 385/134

* cited by examiner

*Primary Examiner*—Tho D. Ta
(74) *Attorney, Agent, or Firm*—Wei Te Chung

(57) ABSTRACT

A portable memory device (1) includes a memory unit, a USB mating port (20) electrically connecting with the memory unit, a protective case (30) detachably mated with the USB mating port and a plastic waterproof member (32) secured in the case. The plastic waterproof member is pressed against a periphery (213) of the USB mating port to seal a gap between the USB mating port and the case. The USB mating port is protected in the case form water penetration. Moreover, the plastic waterproof member imposes a force rising from plastic deformation of the plastic waterproof member on the USB mating port. Therefore, the USB mating port and the case is firmly engaged with each other.

15 Claims, 5 Drawing Sheets

PORTABLE MEMORY DEVICE WITH WATERPROOF STRUCTURE

BACKGROUND OF THE INVENTION

1. Field of the Invention

The present invention generally relates to a portable memory device, and particularly to a portable memory device with a waterproof structure which can provide the memory device a good protection.

2. Description of Related Art

A kind of memory device disclosed in U.S. Pat. No. 6,926,544 B2 (the '544 patent) and U.S. Pat. No. 6,808,400 B2 (the '400 patent) is internally provided with memory unit for storing and transmitting data. The memory device is equipped with a Universal Serial Bus (USB) port playing role of plug and interference between the memory unit and a computer. The computer could read data stored in the memory unit through the USB port or could record necessary data on the memory unit. When the USB port detached from the computer, the memory device can be carried by a user to any other place or be connected to another computer. Therefore, the portable memory device is highly mobile and convenient for use.

Such memory device generally has a structure to protect the USB port from collision, damage, distortion or deformation, e.g. the cover, the spring and positioning structure in the '544 patent and the '400 patent. However, there is a problem that once the memory device is in a watery or wet condition or even be dropped in water by carelessness, the memory devices of the prior arts are susceptible to water leakage that lead to short-out and damage the circuits connected with the USB port, as the cover of the '544 patent is discontinuous with the USB port and the USB port of the '400 patent is still exposed to exterior in their protective position.

So, it is necessary to provide a memory device with waterproof structure to protect the device from water leakage in order to withstand a watery condition.

BRIEF SUMMARY OF THE INVENTION

Accordingly, it is an object of the present invention to provide a portable memory device with a waterproof structure to protect a USB mating port thereof.

In order to achieve the above-mentioned object, a portable memory device with a waterproof structure is provided. The portable memory device comprises a memory unit, a USB mating port electrically connecting with the memory unit, a protective case detachably mated with the USB mating port to have the mating port unexposed outside, and a plastic waterproof member secured in the case, the plastic waterproof member being pressed against a periphery of the USB mating port to seal a gap between the USB mating port and the case. The USB mating port is protected in the case form water leakage. Furthermore, the plastic waterproof member imposes a perpendicular force on the USB mating port rising from plastic deformation thereof. Therefore, the USB mating port and the case is firmly engaged with each other.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
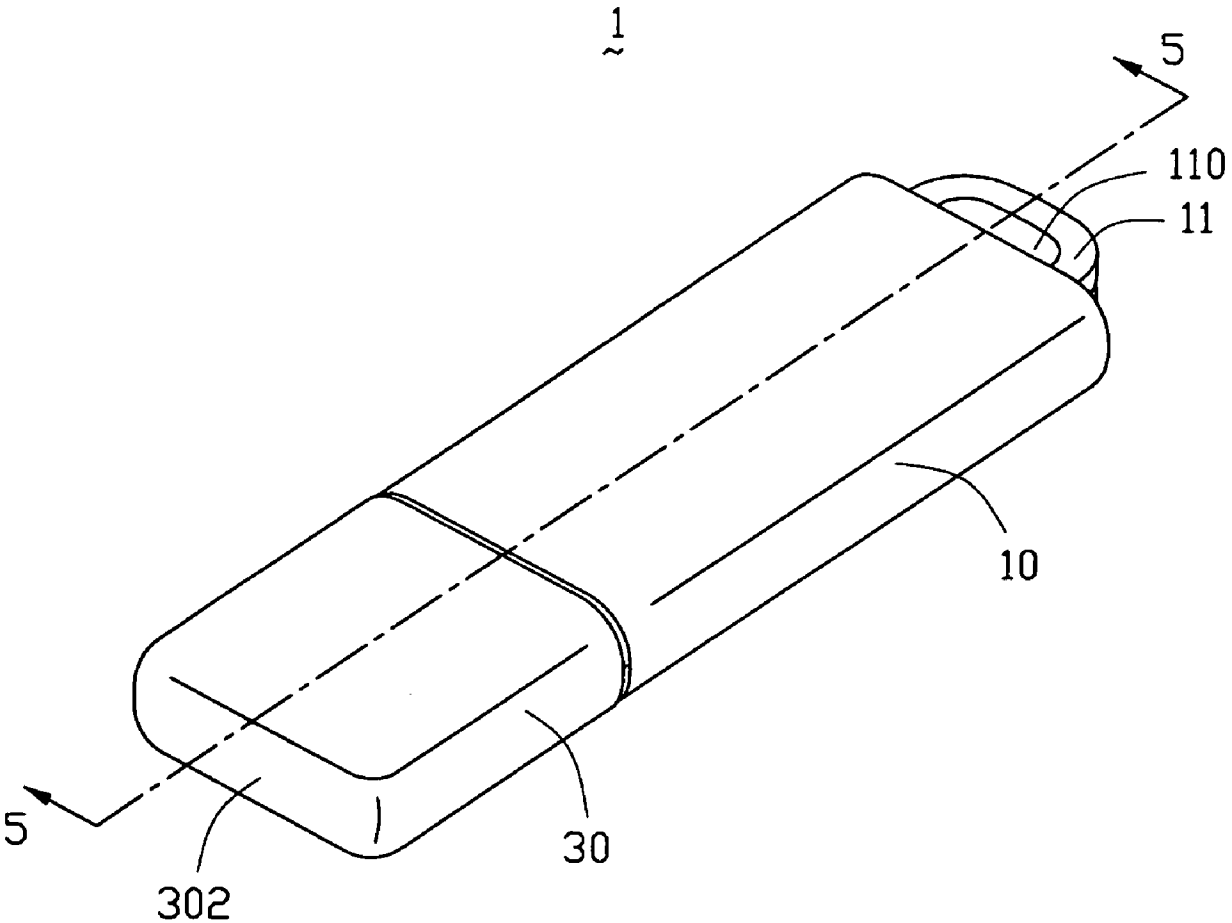
FIG. 1 is a perspective schematic assembly view of a portable memory device with a protective case in accordance with the preferred embodiment of the present invention.

Reference will now be made to the drawing figures to describe the present invention in detail.

Figure 2:
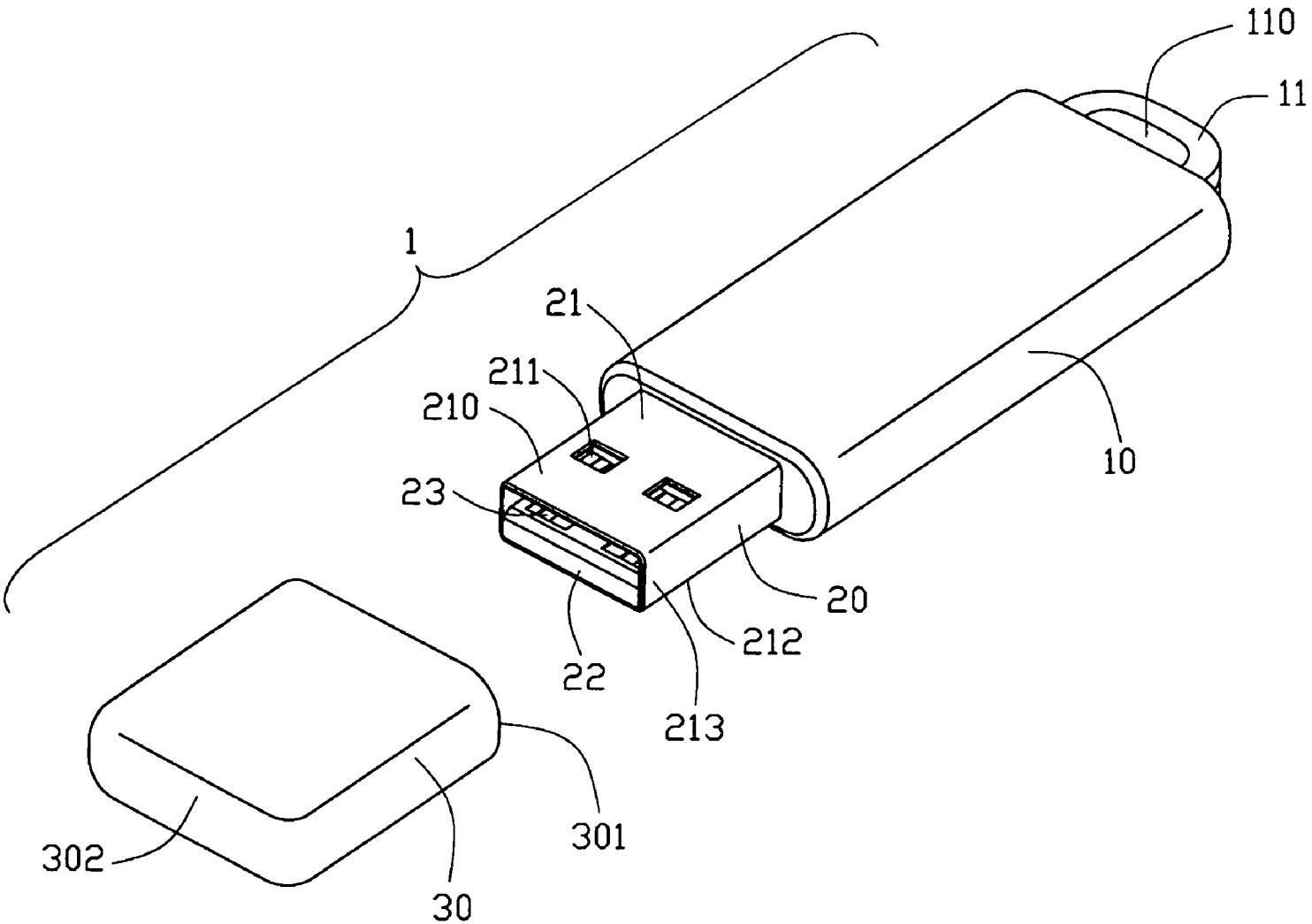
FIG. 2 a perspective schematic view showing a USB mating port of the portable memory device detached from the protective case.
Figure 3:
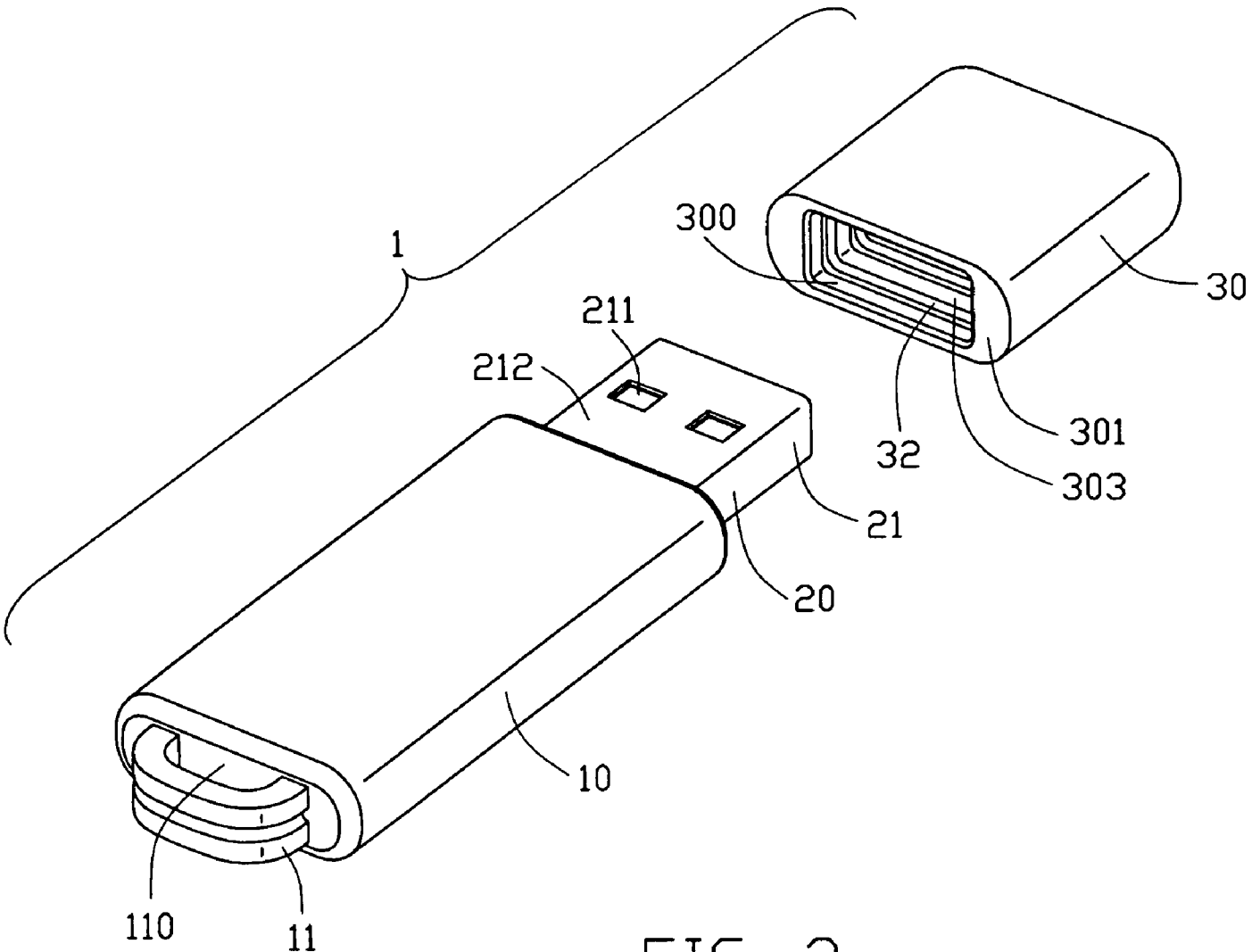
FIG. 3 is a view similar to FIG. 2, while taken from another aspect.

With reference to FIGS. 1–3, a portable memory device 1 in accordance with the present invention comprises an elongate insulative housing 10, a memory unit (not shown) received in the insulative housing 10, a USB mating port 20 electrically connecting with the memory unit, a protective case 30 detachably mated with the USB mating port 20 in a mating direction and a pair of waterproof members 32 secured in the case 30 to waterproof a gap between the protective case 30 and the mating port 20.

The insulative housing 10 extends in a longitudinal direction. One end of insulative housing 10 is provided with the USB mating port 20, while the other end thereof is provided with a protrusions 11 with a through hole 110 defined therein for a string or a key ring passing through and tied, to facilitate user's carrying of the memory device 1. The USB mating port 20 and the protrusion 11 both extend outside the insulative housing 10. The USB mating port 20 has a conventional structure, which includes a substantial rectangular tubular metal shell 21, a mating set 22 received in the shell 21 and a plurality of contacts 40 arranged on the mating set 22 and electrically connecting with the memory unit. The metal shell 21 defines a pair of opposite sidewalls 210, 212. Two pairs of through holes 211 are defined in the sidewalls 210, 212 symmetrically. An outer surface 213 of the metal shell 21 defines a periphery of the USB mating port 20.

Figure 4:
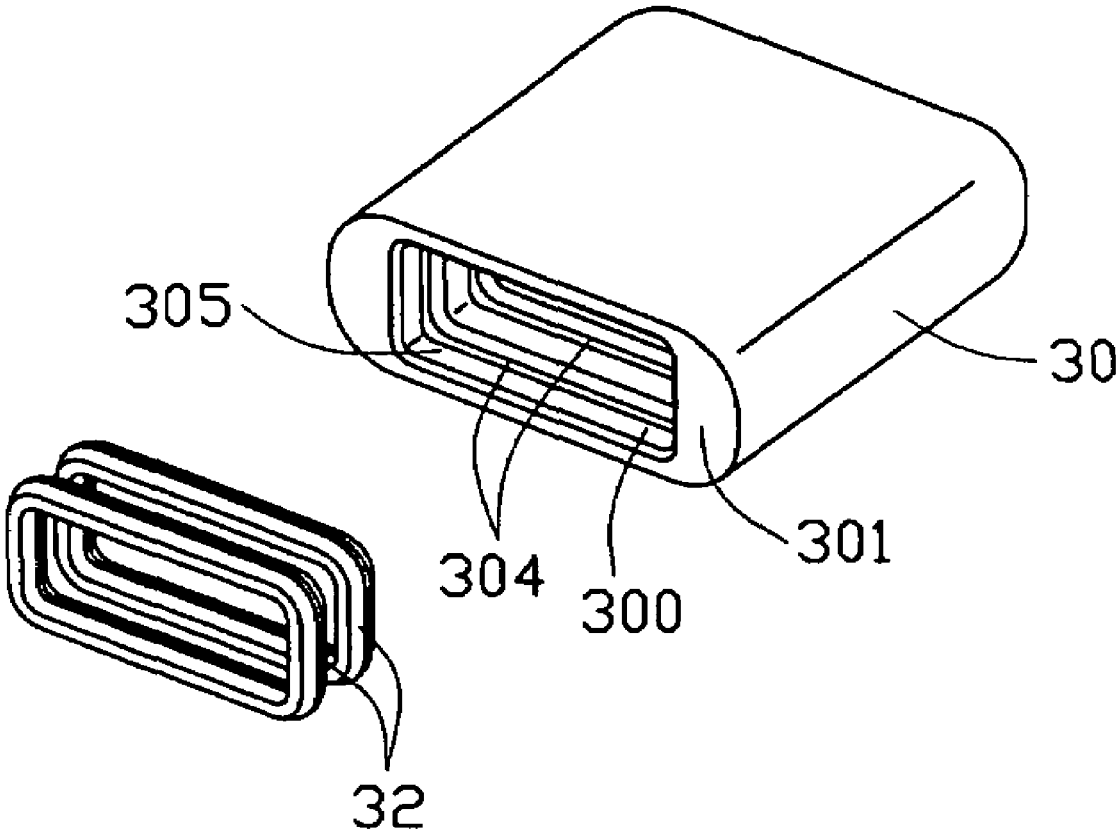
FIG. 4 is an exploded perspective view of the protective case and a pair of waterproof members shown in FIG. 3.
Figure 5:
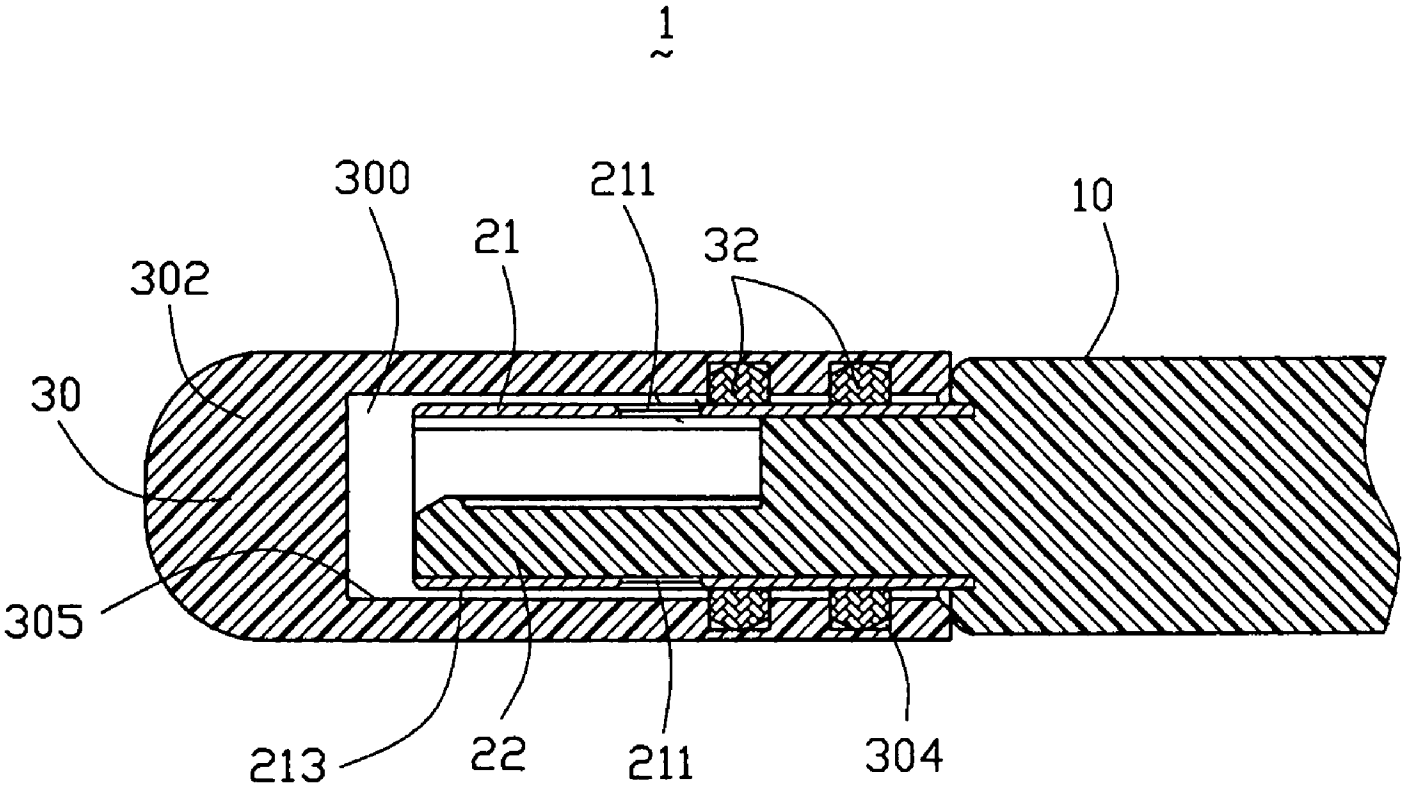
FIG. 5 is a partially sectional view of the protective cap taken along line 5—5 of FIG. 1, showing the waterproof member in the case being pressed against a periphery of the USB mating port when the USB mating port is inserted into the protective case.

Referring to FIGS. 4 and 5 in conjunction with FIG. 3, the case 30 is in a shape of rectangular tube defining a receiving space 300, a mating end 301 with an opening 303 defined therein and a rear end 302 opposite to the mating end 301. The receiving space 300 is enclosed by four sidewalls (not labeled) of the case 30 and the rear end 302. The protective case 30 is recessed a pair of ring-shaped receiving recesses 304 in an inner surface 305 of the case 30. The waterproof members 32 are in a ring shape, too. The pair of waterproof members 32 are made of plastic synthesize rubber. In assembly, the pair of plastic waterproof members 32 is pressed into the receiving recesses 304 and partly into the receiving space 300. As shown in FIG. 5, when the mating port 20 is fully inserted into the protective case 30, the ring shaped waterproof members 32 surround and are pressed against the outer surface 213 of the metal shell 21, and between the through holes 211 and the mating end 301 of the case 30 in the mating direction. The pair of waterproof members 32 seals a gap between the outer surface 213 and the inner surface 305 of the case 30. In other words, a water path into the USB mating port is sealed. The USB mating port 20 is protected in the case 30 from water leakage. Furthermore, the plastic waterproof members 32 impose a perpendicular force, rising from plastic deformation of the plastic waterproof members 32, on the periphery (outer surface 213 of the metal shell 21) of the USB mating port 20. Therefore, the USB mating port 20 and the protective case 30 is firmly engaged with each other. It is noted that there are a pair of waterproof members in the preferred embodiment in accordance the present invention to protect the mating port from water penetration, obviously, a arrangement that one or three plastic waterproof members are provided to protect the mating port from water penetration also meets the waterproof demand discussed above.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A memory device, comprising:

a memory unit with a mating port;

a protective case detachably enclosing the mating port, the protective case defining a receiving space and an opening toward the mating port, the mating port being inserted into the protective case through the opening in a mating direction; and a waterproof member secured in the protective case, the waterproof member pressed against a periphery of the mating port in a direction perpendicular to the mating direction and sealing a gap between the inserted mating port and the protective case;

wherein the mating port comprises an outer metal shell;

wherein the outer metal shell comprises a pair of opposite sidewalls defined therein a pair of through holes respectively, the waterproof member being located between the mating end of the protective case and the through holes in the mating direction.

2. The memory device as claimed in claim 1, wherein the waterproof member is made of plastic rubber material.

3. The memory device as claimed in claim 1, wherein the protective case has a mating end with the opening defined therein, and the mating port defining a front free end received in the receiving space, the waterproof member being located far way from the front free end and adjacent to the mating end of the two protective case.

4. The memory device as claimed in claim 1, wherein said direction is radial.

5. The memory device as claimed in claim 1, wherein the protective case defines a receiving recess therein, the waterproof member being pressed into the receiving recess.

6. The memory device as claimed in claim 5, wherein the waterproof member is a ring shape, surrounding the periphery of the mating port.

7. The memory device as claimed in claim 1, wherein the memory device comprises an insulative housing receiving the memory unit, the mating port projecting from a front end of the insulative housing.

8. The memory device as claimed in claim 7, wherein the memory device comprises a protrusion protruding from a rear end of the insulative housing, the protrusion defining a through hole therein.

9. A portable memory device, comprising:

a memory unit;

a mating port electrically connecting with the memory unit, the mating port having a mating set, a plurality of contacts arranged on the mating set and a metal shell enclosing the mating set and the contacts;

a protective case detachably mated with the mating port to have the mating port unexposed outside, the protective case defining a mating end with an opening defined therein, the mating port being received in the protective case through the opening in a mating direction; and a plastic waterproof member defined in the protective case, the waterproof member being pressed against an outer periphery surface of the metal shell watertightly;

wherein the metal shell comprises a pair of opposite sidewalls defined therein a pair of through holes respectively, the waterproof member being located between the mating end of the protective case and the through holes in the mating direction.

10. The portable memory device as claimed in claim 9, the plastic waterproof member is in a ring shape surrounding the outer surface of the metal shell.

11. The portable memory device as claimed in claim 9, wherein the case cooperates with the metal shell to tightly sandwich the waterproof member therebetween in a radial direction perpendicular to the mating direction so that the waterproof member is compressed and deformed along the radial direction.

12. A portable memory device comprising:

a memory unit assembly including a memory unit enclosed in a housing with a mating port extending forwardly from the housing in a front-to-back direction;

a protective cap defining an inner space receiving said mating port therein, the protective cap defining a mating end with an opening defined therein, the mating port being received in the protective cap through the opening in a mating direction; and a waterproof member surrounding the mating port; wherein when said protective cap is coupled to the mating port in a final position, the waterproof member is deformed in a direction perpendicular to the front-to-back direction to seal a gap which exists between the memory unit assembly and the protective cap when said waterproof member is not provided;

wherein said mating port is defined by a metallic shell;

wherein the metallic shell comprises a pair of opposite sidewalls defined therein a pair of through holes respectively, the waterproof member being located between the mating end of the protective case and the through holes in the mating direction.

13. The memory device as claimed in claim 12, wherein said waterproof member is tightly radially sandwiched between the protective cap and the mating port.

14. The memory device as claimed in claim 12, wherein said waterproof member is associatively retained in the inner face of the cap.

15. The memory device as claimed in claim 12, wherein the waterproof member is located at a position relatively adjacent to an entrance of the protective cap and relatively far away from an entrance of the mating port when the protective cap is coupled to the mating port.

* * * * *